US009229391B2

(12) United States Patent
Kondo

(10) Patent No.: US 9,229,391 B2
(45) Date of Patent: Jan. 5, 2016

(54) BELT DRIVE DEVICE, ANCHORING DEVICE PROVIDED WITH SAME, AND IMAGE FORMING DEVICE

(71) Applicant: KYOCERA Document Solutions Inc., Osaka (JP)

(72) Inventor: Akihiro Kondo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/385,912

(22) PCT Filed: Aug. 8, 2013

(86) PCT No.: PCT/JP2013/071455

§ 371 (c)(1),
(2) Date: Sep. 17, 2014

(87) PCT Pub. No.: WO2014/045750

PCT Pub. Date: Mar. 27, 2014

(65) Prior Publication Data

US 2015/0050056 A1 Feb. 19, 2015

(30) Foreign Application Priority Data

Sep. 18, 2012 (JP) ..... 2012-204135

(51) Int. Cl.
*G03G 15/20* (2006.01)

(52) U.S. Cl.
CPC ..... *G03G 15/2053* (2013.01); *G03G 15/2017* (2013.01); *G03G 2215/2032* (2013.01)

(58) Field of Classification Search
CPC ..... G03G 15/2053; G03G 15/2017
USPC ..... 399/165, 302, 303, 328, 329
See application file for complete search history.

(56) References Cited

U.S. PATENT DOCUMENTS

| | | | | |
|---|---|---|---|---|
| 5,471,289 | A * | 11/1995 | Satoh et al. | 399/328 |
| 7,647,006 | B2 * | 1/2010 | Nakamura et al. | 399/165 |
| 2003/0175056 | A1 | 9/2003 | Sato et al. | 399/302 |
| 2004/0076455 | A1 | 4/2004 | Fujiwara | 399/303 |

FOREIGN PATENT DOCUMENTS

| | | | |
|---|---|---|---|
| JP | 5-1751 | A | 1/1993 |
| JP | 5-132180 | A | 5/1993 |

(Continued)

OTHER PUBLICATIONS

International Search Report mailed Oct. 1, 2013, issued to corresponding International Application No. PCT/JP2013/071455.

*Primary Examiner* — Hoang Ngo
(74) *Attorney, Agent, or Firm* — Stein IP LLC

(57) ABSTRACT

The roller members (40) are provided with: a bearing part (41) affixed to a device main body (5*a*); an elastic roller part (42) that is disposed having a gap (D) with the outside peripheral surface of the hot roller (27) and with which an end part (26*a*) of the anchoring belt (26) comes into contact because of the meandering of the anchoring belt (26); and a powder (43) that is disposed between the bearing part (41) and the elastic roller part (42) and restricts the rotation of the elastic roller part (42). The gap (D) is constituted smaller than the thickness (T) of the anchoring belt (26) and the end part (26*a*) of the anchoring belt (26) enters the gap in opposition to the elastic force of the elastic roller part (42) because of the meandering of the anchoring belt (26).

6 Claims, 5 Drawing Sheets

(56) References Cited

FOREIGN PATENT DOCUMENTS

| | | | |
|---|---|---|---|
| JP | 5-297953 | A | 11/1993 |
| JP | 7-89629 | A | 4/1995 |
| JP | 10-282751 | A | 10/1998 |
| JP | 2003-267580 | A | 9/2003 |
| JP | 2004-45959 | A | 2/2004 |
| JP | 2010-117450 | A | 5/2010 |
| JP | 2012-255870 | A | 12/2012 |

* cited by examiner

BELT DRIVE DEVICE, ANCHORING DEVICE PROVIDED WITH SAME, AND IMAGE FORMING DEVICE

CROSS-REFERENCE TO RELATED APPLICATIONS

This application is a national stage of International Application No. PCT/JP2013/071455, filed Aug. 8, 2013, which claims the benefit of priority to Japanese Application No. 2012-204135, filed Sep. 18, 2012, in the Japanese Patent Office. All disclosures of the document(s) named above are incorporated herein by reference.

BACKGROUND OF THE INVENTION

1. Field of the Invention

The present disclosure relates to a belt drive device that restricts, with respect to an endless belt laid under tension across a drive roller and a driven roller, meandering of the belt in an axis direction of the rollers (roller axis direction), a fixing device provided with the same, and an image forming apparatus.

2. Description of the Related Art

Conventionally, in an image forming apparatus, a toner image formed on an image bearing member such as a photosensitive member is transferred onto a recording medium, and the recording medium carrying the toner image is conveyed toward a fixing device, where heat and pressure are applied thereto so that the toner image on the recording medium is fixed onto the recording medium. As the fixing device, there is a belt fixing type fixing device including a fixing belt that is rotatably laid under tension across a fixing roller and a heat roller and a pressing roller that is placed in press contact with the fixing belt, in which a toner image is fixed onto a recording medium while being passed through a nip portion between the fixing belt and the pressing roller.

In the belt fixing type fixing device, when the fixing belt laid under tension across the rollers are being rotated, the fixing belt may move to meander on the rollers in a roller axis direction. Such meandering of the fixing belt is problematic in that it leads to a fixing failure such as a toner image being positionally displaced on a recording medium, and continued meandering of the fixing belt might cause a breakage of end portions of the belt in a width direction thereof, which has been disadvantageous. Furthermore, not only in the belt fixing type fixing device but also with an endless belt laid under tension over a plurality of rollers including a drive roller, such as, for example, an intermediate transfer belt onto which a toner image is transferred or a conveyer belt for carrying and conveying a recording medium, there occurs a problem similar to the above.

In order to avoid this, there is conventionally known a technique for suppressing belt meandering. For example, in a belt drive device described in Patent Document 1, there is provided a press contact member that comes into press contact with a belt on one end side thereof in a width direction, which is laid over a drive roller and a driven roller, and a relative positional relationship between the drive roller and the driven roller is adjusted beforehand so as to cause the belt to move to the one end side. When rotating, a belt 12 gradually moves to the one end side, and as the belt moves further to the one end side, one end portion of the belt is pressed against the press contact member. As the one end portion of the belt is pressed further against the press contact member, a force acting to cause the belt to move to the other end side gradually increases to such an extent that the forces acting to cause the belt to move to the both end sides, respectively, become balanced. When these forces acting to cause the belt to move to the both end sides become balanced, the movement of the belt in the width direction stops, and thus meandering of the belt is restricted.

Furthermore, in a belt drive device described in Patent Document 2, at one end portion of a belt, a rib annularly protruding along a running direction of the belt and a restriction member that is contactable with the rib are provided, and when the belt meanders, the rib provided at the belt comes into contact with the restriction member, thus restricting meandering of the belt.

Furthermore, a belt drive device described in Patent Document 3 includes a belt that is laid under tension over a drive roller and a meandering correction roller, a meandering detection sensor that comes into contact with an end portion of the belt and detects meandering of the belt, a meandering correction cam that is driven to rotate by a motor so as to cause the meandering correction roller to swing, and a clutch that causes the motor to rotate based on a result of detection by the meandering detection sensor. Upon the meandering detection sensor detecting meandering of the belt, the clutch becomes engaged to transmit a rotary force of the motor to the meandering correction cam. This causes the meandering correction cam to start rotating, so that the meandering correction roller swings in such a direction as to correct the meandering of the belt.

List Of Citations

Patent Literature

Patent Document 1: JP-A-H05-132180 (paragraphs [0020] to [0023], FIG. 1)

Patent Document 2: JP-A-H07-89629 (paragraphs [0028], [0029], FIG. 3)

Patent Document 3: JP-A-H05-297953 (paragraphs [0013] to [0022], FIG. 1, FIG. 3)

SUMMARY OF THE INVENTION

Technical Problem

The belt drive device described in Patent Document 1, however, has been problematic in that, due to its configuration in which the one end portion of the belt is pressed against the press contact member, bending stress is always exerted on the end portion of the belt where strength of the belt is relatively low, which results in a decrease in durability of the belt.

Furthermore, as for the belt drive device described in Patent Document 2, in a case where a rib made of a material different from that of the belt is firmly attached by bonding or the like to an outer peripheral surface of the belt, when, as a result of meandering of the belt, the restriction member is being in contact with the rib, the rib might come off from the outer peripheral surface of the belt.

Furthermore, the belt drive device described in Patent Document 3 includes, for the purpose of correcting meandering of the belt, the detection sensor, the motor, the clutch, and a meandering correction mechanism and thus is structurally complex and costly.

The present disclosure has been made to solve the above-described problems and has as its object to provide a belt drive device that restricts belt meandering stably for a long period of time by using a less costly and simpler configuration, a fixing device provided with the same, and an image forming apparatus.

Solution to the Problem

In order to achieve the above-described object, a first aspect of the invention resides in a belt drive device that restricts, with respect to an endless belt laid under tension over a drive roller and a driven roller, meandering of the belt in a roller axis direction. The belt drive device includes a roller member that is arranged at each of both end portions of the driven roller in an axis direction thereof and restricts meandering of the belt in the roller axis direction. The roller member has a support shaft portion that is fastened to an apparatus main body, an elastic roller portion that is rotatably supported to the support shaft portion and with which, as a result of meandering of the belt, an end portion of the belt in a width direction thereof comes into contact, and a brake portion that is arranged between the support shaft portion and the elastic roller portion and brakes rotation of the elastic roller portion. The elastic roller portion is constituted by having a side surface portion that is opposed to the end portion of the belt and an outer peripheral portion that is opposed to an outer peripheral surface of the driven roller via a predetermined clearance. The clearance is configured to be smaller than a thickness of the belt, and when the end portion of the belt has entered the clearance against an elastic force of the elastic roller portion, a rotational load of the belt at the end portion is increased by using a braking force of the brake portion so as to restrict meandering of the belt in the roller axis direction.

Advantageous Effects of the Invention

According to the first aspect of the invention, in a case where the belt meanders in the roller axis direction, the one end portion of the belt enters the clearance between the outer peripheral surface of the driven roller and the outer peripheral portion of the elastic roller portion against the elastic force of the elastic roller portion. In a state where the one end portion of the belt has entered the clearance and thus the belt and the elastic roller portion are in contact with each other, when the belt rotates, the elastic roller portion rotates following the rotation of the belt. When rotating following the rotation of the belt, the elastic roller portion rotates under a rotational load applied by the brake portion. Thus, while the one end portion of the belt being in contact with the elastic roller portion also is subjected to the rotational load of the elastic roller portion and thus has a decreased rotational speed, the other end portion of the belt rotates at a speed higher than that of the one end portion, and this causes the belt to move toward the other end portion, so that the meandering of the belt is corrected. As described above, by using a less costly and simpler configuration in which the roller member is arranged at each of the both end portions of the driven roller, belt meandering can be restricted stably for a long period of time.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Hereinafter, embodiments of the present disclosure will be described with reference to the appended drawings without limiting the present disclosure thereto. Furthermore, intended uses of the invention, terms used herein, and so on are not limited thereto.

(First Embodiment)

Figure 1:
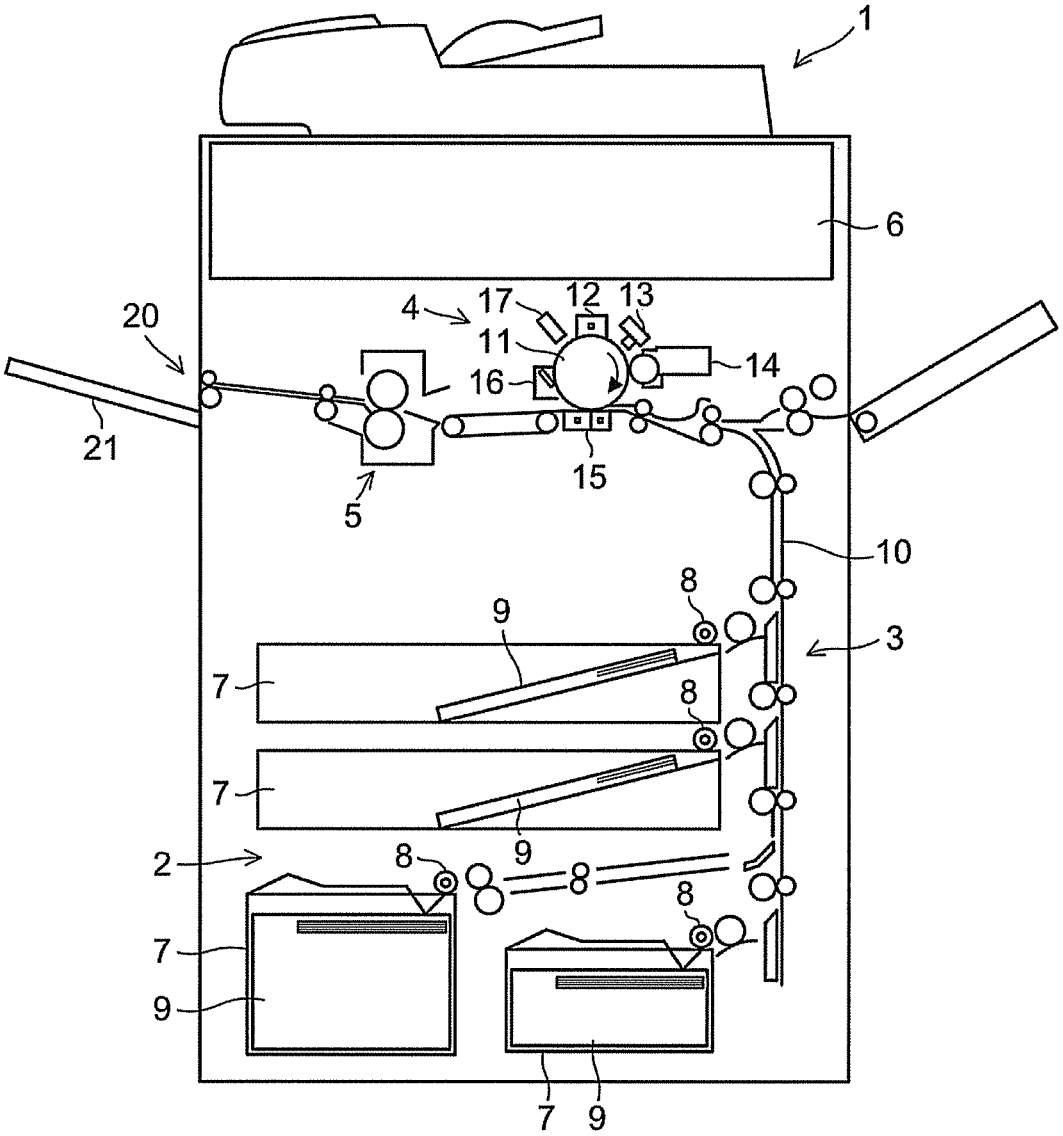
FIG. 1 is a schematic view showing an overall configuration of an image forming apparatus including a belt drive device according to a first embodiment of the present disclosure.

FIG. 1 is a view showing a configuration of an image forming apparatus including a belt drive device according to an embodiment of the present disclosure. An image forming apparatus 1 includes a paper feed portion 2 that is arranged at a lower portion therein, a paper sheet conveying portion 3 that is arranged on a lateral side of the paper feed portion 2, an image forming portion 4 that is arranged on an upper side of the paper sheet conveying portion 3, a fixing device 5 that is arranged on an ejection side in a paper sheet conveying direction with respect to the image forming portion 4, and an image reading portion 6 that is arranged on an upper side of the image forming portion 4 and the fixing device 5.

The paper feed portion 2 includes a plurality of paper feed cassettes 7 for housing a paper sheet 9 that is a recording medium and, by way of rotation of a paper feed roller 8, feeds out the paper sheet 9 one by one from a selected one of the plurality of paper feed cassettes 7 to the paper sheet conveying portion 3.

The paper sheet 9 fed to the paper sheet conveying portion 3 is conveyed toward the image forming portion 4 via a paper sheet conveying path 10 provided in the paper sheet conveying portion 3. The image forming portion 4 is to form a toner image on the paper sheet 9 by an electrophotographic process and includes a photosensitive member 11 that is supported so as to be rotatable in an arrow direction in FIG. 1, and around the photosensitive member 11, along a rotation direction thereof, there are provided a charging portion 12, an exposure portion 13, a developing potion 14, a transfer portion 15, a cleaning portion 16, and a static elimination portion 17.

The charging portion 12 has a charging wire to which a high voltage is applied, and through corona discharge from the charging wire, a predetermined potential is applied to a surface of the photosensitive member 11, so that the surface of the photosensitive member 11 is uniformly charged. Then, the exposure portion 13 irradiates the photosensitive member 11 with light based on image data of an original document read by the image reading portion 6, and thus a surface potential of the photosensitive member 11 is selectively attenuated, so that an electrostatic latent image is formed on the surface of the photosensitive member 11.

Next, the developing portion 14 develops the electrostatic latent image on the surface of the photosensitive member 11, and thus a toner image is formed on the surface of the photosensitive member 11. By the transfer portion 15, the toner image is transferred onto the paper sheet 9 supplied between the photosensitive member 11 and the transfer portion 15.

The paper sheet 9 onto which the toner image has been transferred is conveyed toward the fixing device 5 disposed on a downstream side in the paper sheet conveying direction with respect to the image forming portion 4. In the fixing device 5, the paper sheet 9 is heated and pressed, and thus the toner image is fused to be fixed onto the paper sheet 9. Next, by an ejection roller pair 20, the paper sheet 9 onto which the toner image has been fixed is ejected onto an ejection tray 21.

After the toner image has been transferred onto the paper sheet 9 by the transfer portion 15, toner remaining on the surface of the photosensitive member 11 is removed by the cleaning portion 16, and residual charge remaining on the surface of the photosensitive member 11 is removed by the static elimination portion 17. Then, the photosensitive member 11 is charged again by the charging portion 12 and used for a subsequent similar round of image formation.

Figure 2:
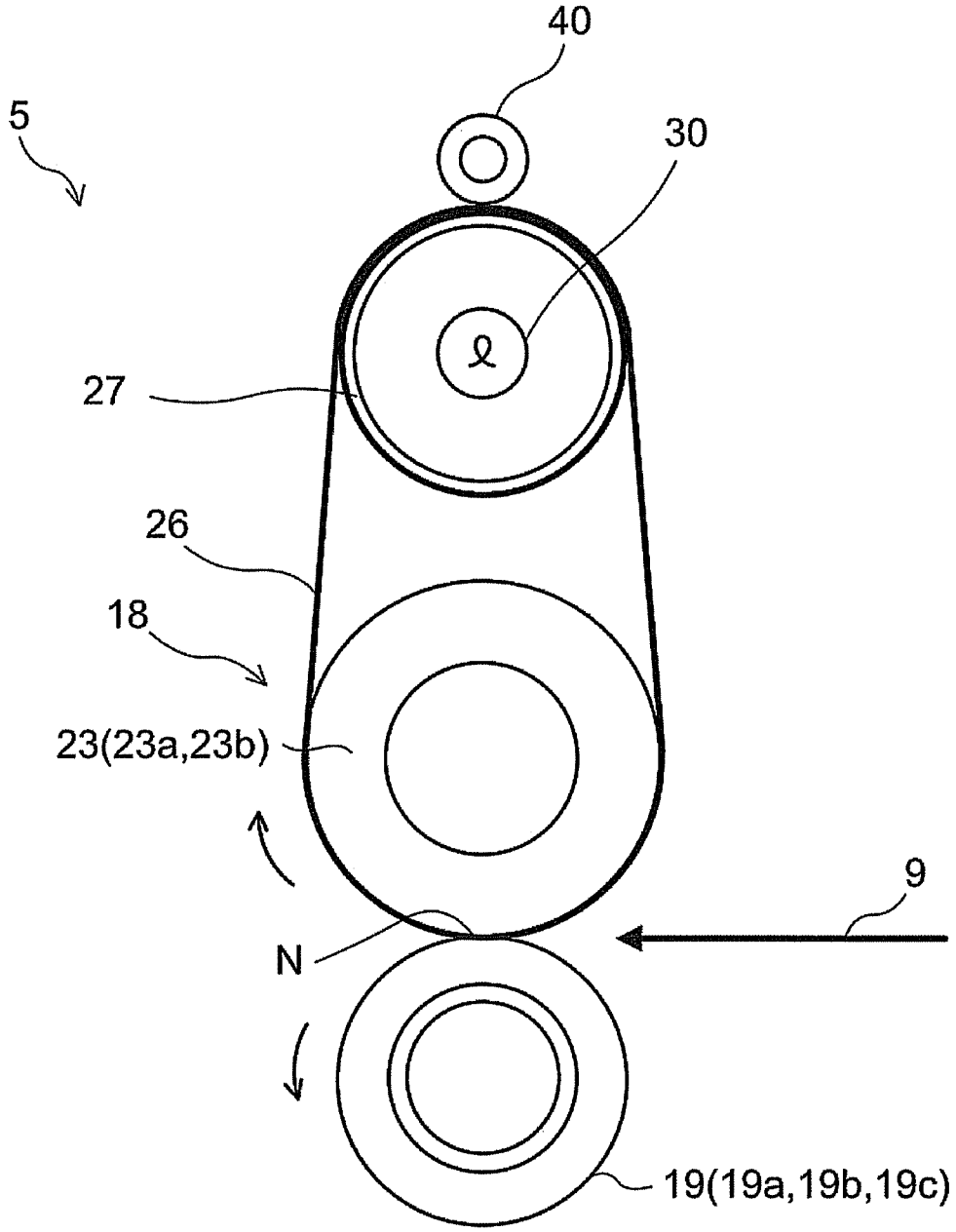
FIG. 2 is a side sectional view showing a configuration of a fixing device provided with the belt drive device according to the first embodiment.

The fixing device 5 provided with the belt drive device is configured as shown in FIG. 2. FIG. 2 is a side sectional view showing a configuration of the fixing device 5.

The fixing device 5 includes a heating portion 18 and a pressing roller 19. The heating portion 18 includes an endless fixing belt 26, a fixing roller 23 that is provided inside the loop of the fixing belt 26, a heat roller 27 that constitutes, together with the fixing roller 23, rollers over which the fixing belt 26 is laid under tension, and a heater 30 that is a heating unit provided inside the heat roller 27. The belt drive device includes the fixing roller 23 that is a drive roller, the heat roller 27 that is a driven roller, the fixing belt 26 that is a belt laid under tension over the fixing roller 23 and the heat roller 27, and a roller member 40.

By a drive source such as a motor (not shown), the pressing roller 19 is driven to rotate in an arrow direction in FIG. 2 and, further by a pressure adjustment mechanism (not shown), is pressed at a predetermined pressure in a direction of a center axis of the fixing roller 23. As a result, the pressing roller 19 is brought into press contact with the fixing roller 23 via the fixing belt 26. Driving the pressing roller 19 to rotate causes the fixing belt 26 and the fixing roller 23 to rotate in an arrow direction in FIG. 2, and moreover, the heat roller 27 rotates following the rotation of the fixing belt 26. At a portion where the fixing belt 26 and the pressing roller 19 come into contact with each other, a nip portion N is formed.

Furthermore, the pressing roller 19 includes a cylindrical core bar 19*a*, an elastic layer 19*b* that is formed on the core bar 19*a*, and a mold release layer 19*c* that covers a surface of the elastic layer 19*b*. The fixing roller 23 has a core bar 23*a* and an elastic layer 23*b* that is provided on the core bar 23*a*, and with the fixing belt 26 laid under tension over the elastic layer 23*b*, the fixing roller 23 rotates integrally with the fixing belt 26. In order that the heat roller 27 can rotate together with the fixing belt 26, over the heat roller 27, the fixing belt 26 is laid under tension with an inner peripheral surface thereof facing the heat roller 27, and the heat roller 27 is formed of a core bar coated with Teflon (registered trademark) or the like having excellent slidability. The fixing belt 26 is an endless heat-resistant belt and is configured by having, on an inner peripheral side thereof, an elastic layer of a silicone rubber or the like, and on an outer peripheral side thereof with respect to the elastic layer, a mold release layer that is formed of a fluorocarbon resin tube or the like and provides improved mold releasability when an unfixed toner image is fused to be fixed at the nip portion N.

Upon the fixing belt 26 being heated by the heater 30 via the heat roller 27 to a predetermined temperature, the paper sheet P held in a sandwiched manner at the nip portion N is heated, while being also pressed by the pressing roller 19, so that toner in a powdered state on the paper sheet P is fused to be fixed on the paper sheet 9. As described above, the fixing belt 26 is made of a thin material having excellent thermal conductivity and thus has a small thermal capacity, so that a warm-up time can be reduced to quicken the start of image formation.

When the fixing belt 26 laid under tension over the fixing roller 23 and the heat roller 27 rotates, due to, for example, axial cores of the fixing roller 23 and the heat roller 27 being inclined with respect to each other, the fixing belt 26 moves (meanders) in a roller axis direction. The roller member 40 restricts such meandering of the fixing belt 26 in the roller axis direction.

Figure 3:
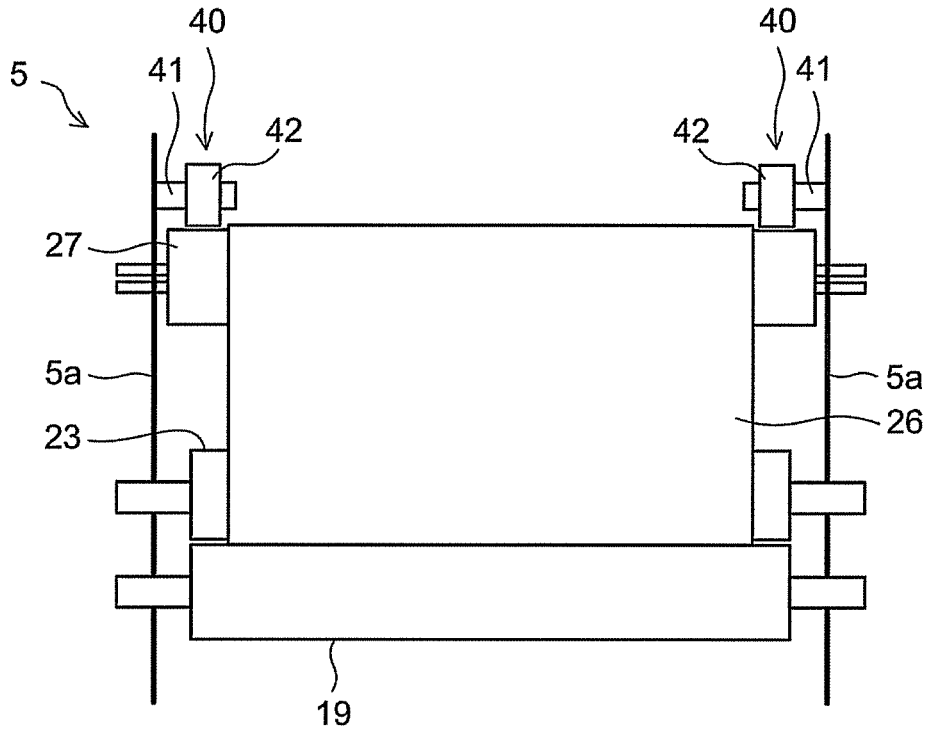
FIG. 3 is a plan view showing a belt drive device including a roller member according to the first embodiment.
Figure 4:
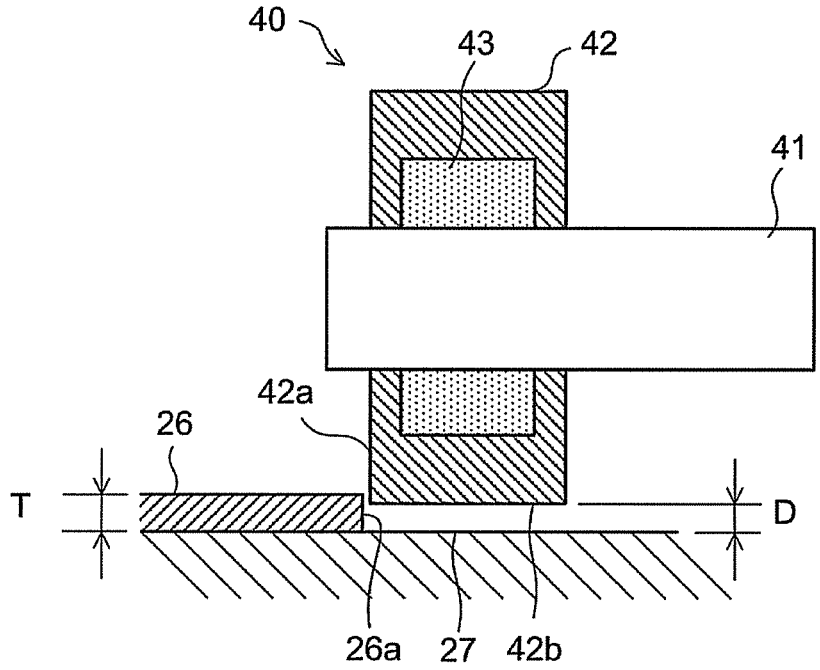
FIG. 4 is a sectional view showing the roller member according to the first embodiment.
Figure 5:
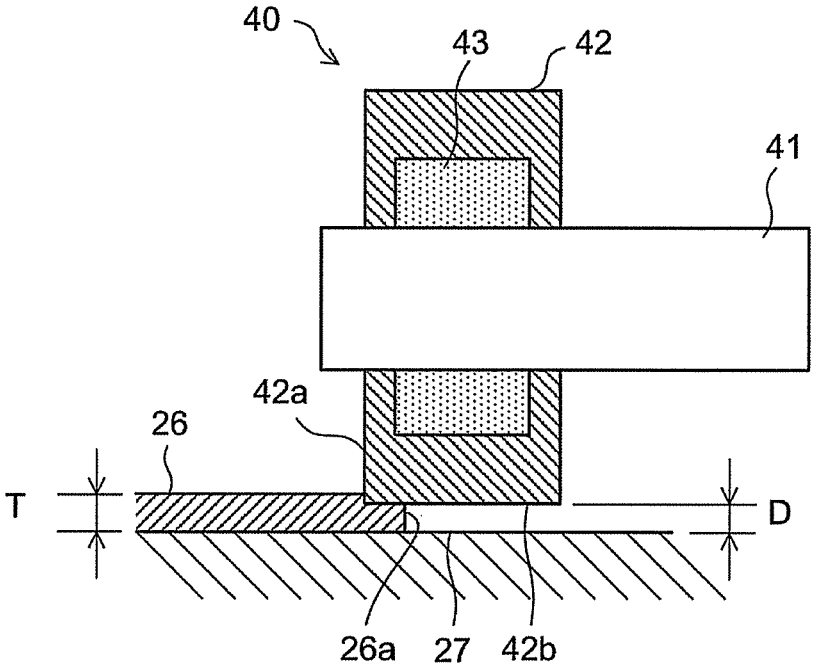
FIG. 5 is a sectional view showing a state where an end portion of a belt has entered a clearance so as to restrict meandering of the belt, according to the first embodiment.

FIGS. 3 to 5 show a detailed configuration of the roller member 40. FIG. 3 is a plan view showing a configuration of a belt drive device including the roller member 40. FIG. 4 is a sectional view showing the roller member 40. FIG. 5 is a sectional view showing a state where an end portion of the fixing belt 26 has entered a clearance so as to restrict meandering of the fixing belt 26. FIGS. 4 and 5 show one, on a right side, of a pair of the roller members 40 and 40 shown in FIG. 3. The pair of the roller members 40 and 40, though arranged to be oriented differently from each other in a lateral direction as shown in FIG. 3, are the same in configuration.

As shown in FIG. 3, the pressing roller 19, the fixing roller 23, and the heat roller 27 are rotatably supported in an apparatus main body 5*a* of the fixing device 5.

The roller members 40 and 40 are arranged at both end portions of the heat roller 27 in an axis direction thereof and each have a support shaft portion 41 that is fastened to the apparatus main body 5*a*, an elastic roller portion 42, and a powder 43 (see FIG. 4) that is a brake portion.

As shown in FIG. 4, the elastic roller portion 42 is made of a material having elasticity such as a silicone rubber and is formed in a cylindrical shape. The elastic roller portion 42 is rotatably held to the support shaft portion 41 without moving with respect to the support shaft portion 41 in an axis direction thereof.

A side surface portion 42*a* of the elastic roller portion 42 is provided to be opposed to an end portion 26*a* of the fixing belt 26 in a width direction thereof (a direction perpendicular to a running direction of the fixing belt 26). In a case where the fixing belt 26 rotates without meandering, the elastic roller portion 42 is arranged with such a gap in a width direction that the side surface portion 42*a* thereof does not come into contact with the end portion 26*a* of the fixing belt 26.

An outer peripheral portion 42*b* of the elastic roller portion 42 is provided to be opposed to and spaced at a clearance D from an outer peripheral surface of the heat roller 27. The clearance D is configured to be slightly smaller than a thickness T of the fixing belt 26. In a case where the fixing belt 26 moves (meanders) in the roller axis direction, the end portion 26*a* of the fixing belt 26 enters the clearance D against an elastic force of the elastic roller portion 42.

The powder 43 is made of relatively small-sized particles such as of sand and is sealed in a space formed by an outer peripheral surface of the support shaft portion 41 and an inner peripheral surface and both side surfaces of the elastic roller portion 42. The powder 43 is interposed between the support shaft portion 41 fastened to the apparatus main body 5*a* and the rotatable elastic roller portion 42, and thus when the elastic roller portion 42 rotates with respect to the support shaft portion 41, due to a braking force (frictional force) of the powder 43, a rotational load of the elastic roller portion 42 is increased. By changing an amount or size of the particles of the powder 43 to be sealed, the breaking force of the powder 43 is changed, and thus the rotational load of the elastic roller portion 42 with respect to the support shaft portion 41 can be changed.

In the above-described configuration, in a case where the fixing belt 26 is rotating without meandering, i.e. in a case where the end portion 26*a* of the fixing belt 26 is not in contact with the side surface portion 42*a* of the elastic roller portion 42, the roller member 40 is stopped from rotating.

In a case where the fixing belt 26 meanders in the roller axis direction, as shown in FIG. 5, the end portion 26*a* of the fixing belt 26 enters the clearance D against the elastic force of the elastic roller portion 42. In a state where the end portion 26*a* of the fixing belt 26 has entered the clearance D and thus the fixing belt 26 and the elastic roller portion 42 are in contact with each other, when the fixing belt 26 rotates, the elastic roller portion 42 rotates following the rotation of the fixing belt 26. When rotating following the rotation of the fixing belt 26, the elastic roller portion 42 rotates under a rotational load due to the braking force of the powder 43. Thus, while the one end portion 26*a* of the fixing belt 26 (an end portion of the fixing belt 26 on a right side in FIG. 3) being in contact with the elastic roller potion 42 also is subjected to the rotational load of the elastic roller portion 42 and thus has a decreased rotational speed, the other end portion 26*a* of the fixing belt 26 (an end portion of the fixing belt 26 on a left side in FIG. 3) rotates at a speed higher than that of the one end portion 26*a*, and this causes the fixing belt 26 to move toward the other end portion 26*a*. That is, a return is made to a state shown in FIG. 4, and thus the meandering of the fixing belt 26 is corrected.

As described above, by using a less costly and simpler configuration in which the roller member 40 is arranged at each of the both end portions of the heat roller 27, belt meandering can be restricted stably for a long period of time.

(Second Embodiment)

Figure 6:
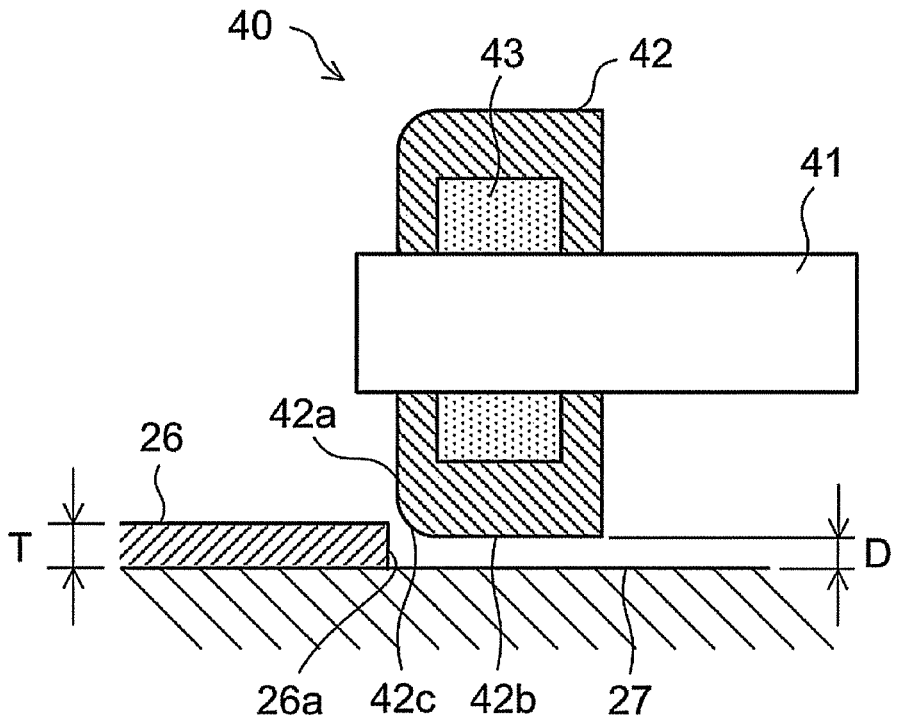
FIG. 6 is a sectional view showing a roller member according to a second embodiment of the present disclosure.

FIG. 6 is a sectional view showing a roller member 40 according to a second embodiment of the present disclosure. The second embodiment has a configuration in which a beveled portion is formed at an edge portion of the roller member 40 so that, in a case where a fixing belt 26 meanders, entry of an end portion 26*a* of the fixing belt 26 into a clearance D is facilitated. The following mainly describes the roller member 40, which is configured differently from that of the first embodiment, and omits descriptions of the same portions as those in the first embodiment.

The roller member 40 has a support shaft portion 41 that is fastened to an apparatus main body 5*a*, an elastic roller portion 42, and a powder 43.

The elastic roller portion 42 is made of a material having elasticity such as a silicone rubber and formed in a cylindrical shape. The elastic roller portion 42 is rotatably held to the support shaft portion 41 without moving with respect to the support shaft portion 41 in an axis direction thereof.

A side surface portion 42*a* of the elastic roller portion 42 is provided to be opposed to the end portion 26*a* of the fixing belt 26. An outer peripheral portion 42*b* of the elastic roller portion 42 is opposed to an outer peripheral surface of a heat roller 27 via the clearance D. At an edge portion between the side surface portion 42*a* and the outer peripheral portion 42*b* of the elastic roller portion 42, an annular beveled portion 42*c* is formed.

The clearance D is configured to be slightly smaller than a thickness T of the fixing belt 26. In a case where the fixing belt 26 moves (meanders) in a roller axis direction, the end portion 26*a* of the fixing belt 26 enters the clearance D against an elastic force of the elastic roller portion 42. When the end portion 26*a* of the fixing belt 26 enters the clearance D, the beveled portion 42*c* allows the end portion 26*a* to move smoothly into the clearance D.

The powder 43 is made of relatively small-sized particles such as of sand and is sealed in a space formed by an outer peripheral surface of the support shaft portion 41 and an inner peripheral surface and both side surfaces of the elastic roller portion 42. The powder 43 is interposed between the support shaft portion 41 fastened to the apparatus main body 5*a* and the rotatable elastic roller portion 42, and thus when the elastic roller portion 42 rotates with respect to the support shaft portion 41, due to a braking force of the powder 43, a rotational load of the elastic roller portion 42 is increased.

In the above-described configuration, in a case where the fixing belt 26 meanders in the roller axis direction, the end portion 26*a* of the fixing belt 26 comes into contact with the beveled portion 42*c* of the elastic roller portion 42 and then enters the clearance D against the elastic force of the elastic roller portion 42. In a state where the end portion 26*a* of the fixing belt 26 has entered the clearance D and thus the fixing belt 26 and the elastic roller portion 42 are in contact with each other, when the fixing belt 26 rotates, the elastic roller portion 42 rotates following the rotation of the fixing belt 26. When rotating following the rotation of the fixing belt 26, the elastic roller portion 42 rotates under a rotational load due to the braking force of the powder 43. Thus, while the end portion 26*a* of the fixing belt 26 (the end portion of the fixing belt 26 on the right side in FIG. 3) being in contact with the elastic roller potion 42 also is subjected to the rotational load of the elastic roller portion 42 and thus has a decreased rotational speed, the other end portion 26*a* of the fixing belt 26 (the end portion of the fixing belt 26 on the left side in FIG. 3) rotates at a speed higher than that of the one end portion 26*a*, and this causes the fixing belt 26 to move toward the other end portion 26*a*. That is, a return is made to a state shown in FIG. 6, and thus the meandering of the fixing belt 26 is corrected.

As described above, by using a less costly and simpler configuration in which the roller member 40 is arranged at each of the both end portions of the heat roller 27, belt meandering can be restricted stably for a long period of time.

(Third Embodiment)

Figure 7:
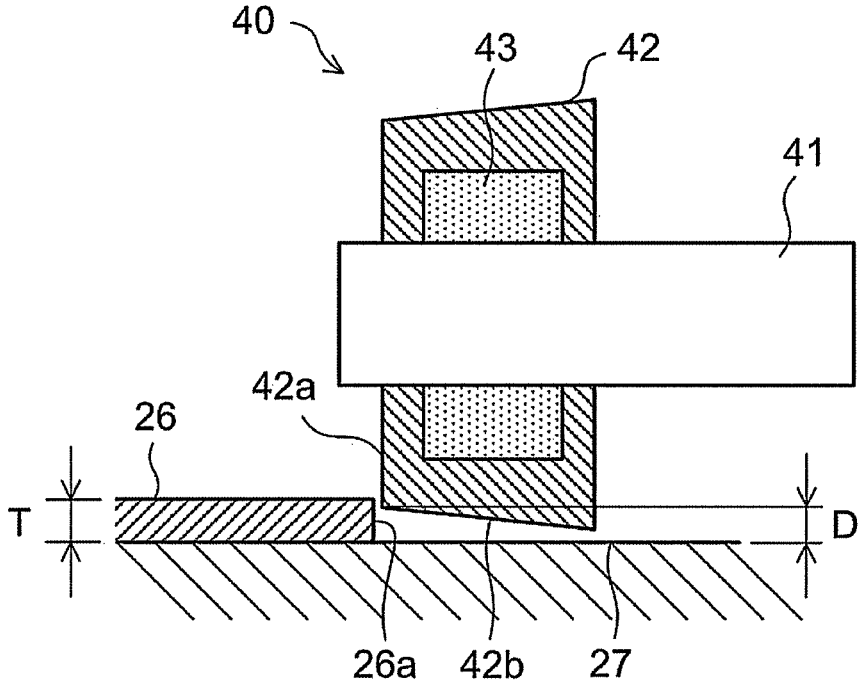
FIG. 7 is a sectional view showing a roller member according to a third embodiment of the present disclosure.

FIG. 7 is a sectional view showing a roller member 40 according to a third embodiment of the present disclosure. The third embodiment has a configuration in which an outer peripheral portion 42*b* of the roller member 40 is formed to be tapered.

The roller member 40 has a support shaft portion 41 that is fastened to an apparatus main body 5*a*, an elastic roller portion 42, and a powder 43.

The elastic roller portion 42 is made of a material having elasticity such as a silicone rubber and formed in a cylindrical shape. The elastic roller portion 42 is rotatably held to the support shaft portion 41 without moving with respect to the support shaft portion 41 in an axis direction thereof.

A side surface portion 42*a* of the elastic roller portion 42 is provided to be opposed to an end portion 26*a* of a fixing belt 26. An outer peripheral portion 42*b* of the elastic roller portion 42 is opposed to an outer peripheral surface of a heat roller 27 via a clearance D. Moreover, the outer peripheral portion 42*b* of the elastic roller portion 42 is formed to be tapered such that, on a side of the side surface portion 42*a*, the outer peripheral portion 42*b*, together with the outer peripheral surface of the heat roller 27, forms the clearance D, and on a side of an end portion in a roller axis direction (a right side in FIG. 7), the clearance D is smaller than on the side of the side surface portion 42*a*.

The clearance D is configured to be slightly smaller than a thickness T of the fixing belt 26. In a case where the fixing belt 26 moves (meanders) in the roller axis direction, the end portion 26*a* of the fixing belt 26 enters the clearance D against an elastic force of the elastic roller portion 42. As the end portion 26*a* of the fixing belt 26 moves into the backside of the clearance D, a contact pressure exerted by the tapered outer peripheral portion 42*b* is increased to reliably stop the end portion 26*a* from moving further beyond at a predetermined position.

The powder 43 is made of relatively small-sized particles such as of sand and is sealed in a space formed by an outer peripheral surface of the support shaft portion 41 and an inner peripheral surface and both side surfaces of the elastic roller portion 42. The powder 43 is interposed between the support shaft portion 41 fastened to the apparatus main body 5*a* and the rotatable elastic roller portion 42, and thus when the elastic roller portion 42 rotates with respect to the support shaft portion 41, due to a braking force of the powder 43, a rotational load of the elastic roller portion 42 is increased.

In the above-described configuration, in a case where the fixing belt 26 meanders in the roller axis direction, the end portion 26*a* of the fixing belt 26 enters the clearance D against the elastic force of the elastic roller portion 42. As the end portion 26*a* of the fixing belt 26 moves into the backside of the clearance D, a contact pressure exerted by the tapered outer peripheral portion 42*b* is increased to reliably stop the end portion 26*a* from moving further beyond a predetermined position. In a state where the end portion 26*a* of the fixing belt 26 has entered the clearance D and thus the fixing belt 26 and the elastic roller portion 42 are in contact with each other, when the fixing belt 26 rotates, the elastic roller portion 42 rotates following the rotation of the fixing belt 26. When rotating following the rotation of the fixing belt 26, the elastic roller portion 42 rotates under a rotational load due to the braking force of the powder 43. Thus, while the end portion 26*a* of the fixing belt 26 (the end portion of the fixing belt 26 on the right side in FIG. 3) being in contact with the elastic roller potion 42 also is subjected to the rotational load of the elastic roller portion 42 and thus has a decreased rotational speed, the other end portion 26*a* of the fixing belt 26 (the end portion of the fixing belt 26 on the left side in FIG. 3) rotates at a speed higher than that of the one end portion 26*a*, and this causes the fixing belt 26 to move toward the other end portion 26*a*. That is, a return is made to a state shown in FIG. 7, and thus the meandering of the fixing belt 26 is corrected.

As described above, by using a less costly and simpler configuration in which the roller member 40 is arranged at each of the both end portions of the heat roller 27, belt meandering can be restricted stably for a long period of time.

While the foregoing third embodiment shows a configuration in which the outer peripheral portion 42*b* of the elastic roller portion 42 is formed to be tapered, the present disclosure is not limited thereto, and a configuration also may be adopted in which a beveled portion 42*c* is formed at an edge portion between the outer peripheral portion 42*b* formed to be tapered and the side surface portion 42*a*. In this case, entry of the end portion 26*a* of the fixing belt 26 into the clearance D is facilitated, and the end portion 26*a* is reliably stopped from moving further beyond a predetermined position in the clearance D.

Furthermore, while each of the foregoing first to third embodiments shows an example in which the brake potion is formed of the powder 43, the present disclosure is not limited thereto, and the brake portion may be formed of a torque limiter. Also in this case, effects similar to those of the foregoing embodiments can be obtained.

Furthermore, while each of the foregoing first to third embodiments shows a configuration in which the heater 30 is used as a heating unit, the present disclosure is not limited thereto, and a configuration also may be adopted in which the fixing belt 26 is heated by electromagnetic induction.

Furthermore, while each of the foregoing first to third embodiments shows an example in which the belt drive device of the present disclosure is applied to the fixing belt 26 of the fixing device 5, the present disclosure is not limited thereto, and the belt drive device of the present disclosure may be applied also to, for example, in a color image forming apparatus, an endless intermediate transfer belt onto which toner images of respective colors on a photosensitive member are transferred or an endless conveyor belt that carries and conveys a paper sheet. Furthermore, the embodiments of the present disclosure may be applied as appropriate to apparatuses other than an image forming apparatus depending on their necessity, intended use, and so on.

Industrial Applicability

The present disclosure is applicable to a belt drive device that restricts, with respect to an endless belt laid under tension across a drive roller and a driven roller, meandering of the belt in a roller axis direction, a fixing device provided with the same, and an image forming apparatus.

Although a few embodiments of the present invention have been shown and described, it would be appreciated by those skilled in the art that changes may be made in this embodiment without departing from the principles and spirit of the invention, the scope of which is defined in the claims and their equivalents.

The invention claimed is:

1. A belt drive device that restricts, with respect to an endless belt laid under tension over a drive roller and a driven roller, meandering of the belt in a roller axis direction, comprising:

a roller member that is arranged at each of both end portions of the driven roller in an axis direction thereof and restricts meandering of the belt in the roller axis direction, wherein the roller member has:

a support shaft portion that is fastened to an apparatus main body;

an elastic roller portion that is rotatably supported to the support shaft portion and with which, as a result of meandering of the belt, an end portion of the belt in a width direction thereof comes into contact; and a brake portion that is arranged between the support shaft portion and the elastic roller portion and brakes rotation of the elastic roller portion, the elastic roller portion is constituted by having:

a side surface portion that is opposed to the end portion of the belt; and an outer peripheral portion that is opposed to an outer peripheral surface of the driven roller via a predetermined clearance, the clearance is configured to be smaller than a thickness of the belt, and when the end portion of the belt has entered the clearance against an elastic force of the elastic roller portion, a rotational load of the belt at the end portion is increased by using a braking force of the brake portion so as to restrict meandering of the belt in the roller axis direction.

2. The belt drive device according to claim 1, wherein the brake portion is formed of a powder that is sealed between the support shaft portion and the elastic roller portion.

3. The belt drive device according to claim 1, wherein the outer peripheral portion is formed to be tapered such that the clearance diminishes with increasing distance from the side surface portion.

4. The belt drive device according to claim 1, wherein at an edge portion between the side surface portion and the outer peripheral portion of the elastic roller portion, an annular beveled portion is formed.

5. A fixing device, comprising:

the belt drive device according to claim 1, wherein the belt is heated by a heating unit, the drive roller is placed in press contact with a pressing roller via the belt, the driven roller constitutes, together with the drive roller, rollers over which the belt is rotatably laid under tension, and a recording medium is held in a sandwiched manner between the belt and the pressing roller, in which state an unfixed toner image on the recording medium is fused to be fixed.

6. An image faulting apparatus, comprising:

the fixing device according to claim 5.

* * * * *